United States Patent [19]

Eddens

[11] Patent Number: 4,604,785

[45] Date of Patent: Aug. 12, 1986

[54] METHOD OF MAKING FUEL CHANNEL

[75] Inventor: Fletcher C. Eddens, Wilmington, N.C.

[73] Assignee: General Electric Company, San Jose, Calif.

[21] Appl. No.: 685,265

[22] Filed: Dec. 21, 1984

[51] Int. Cl.[4] ..... B21D 39/02

[52] U.S. Cl. ..... 29/463; 29/DIG. 35; 29/447; 72/342; 72/370; 138/151; 228/156

[58] Field of Search ..... 29/463, 447, 520, DIG. 35; 72/342, 286, 370; 228/155, 158, 156; 138/151, 140, 143

[56] References Cited

U.S. PATENT DOCUMENTS

| | | | |
|---|---|---|---|
| 3,298,096 | 1/1967 | Stuart | 228/151 |
| 3,559,278 | 2/1971 | Brandberg et al. | 29/487 |
| 3,854,193 | 12/1974 | Yamaguchi et al. | 29/473.9 |
| 3,986,654 | 10/1976 | Hart et al. | 228/155 |
| 4,233,834 | 11/1980 | Matinlassi | 72/208 |
| 4,376,662 | 3/1983 | Brimm | 148/12.3 |

*Primary Examiner*—Charlie T. Moon

*Attorney, Agent, or Firm*—Ivor J. James, Jr.; Raymond G. Simkins

[57] ABSTRACT

A method for making a nuclear fuel channel is disclosed having a high degree of dimensional accuracy which uses the thermal expansion of a mandrel to precisely size the channel. An assembly of the mandrel and a channel preform is pulled through a die to die sink the preform into substantial surface-to-surface contact with the mandrel prior to the heating step.

9 Claims, 4 Drawing Figures

METHOD OF MAKING FUEL CHANNEL

FIELD OF THE INVENTION

The present invention relates in general to a method for making hollow, thin-walled, precisely dimensioned structures, and more particularly to a method for making precisely dimensioned zirconium alloy fuel channels for use in fuel bundles of the kind used in a nuclear reactor.

BACKGROUND OF THE INVENTION

The use of the technique known as "thermal sizing" is well established in the fabrication of precisely dimensioned tubular bodies and in various other processes. This technique takes advantage of differences in the coefficients of thermal expansion of different metals. A mandrel having a coefficient of thermal expansion greater than that of the tubular body to be sized is used. An assembly of the tubular body and mandrel is heated and, as the mandrel expands at a greater rate than the tubular body, it plastically deforms the latter to the desired dimensions. The assembly is then cooled and the mandrel removed. The difficulty in this process arises from the fact that the difference between the thermal expansion of the mandrel and that of the tubular body is relatively small, i.e. on the order of 0.040 inches for a 5 inch diameter body and a desirable heating temperature. This means that the gap between the inner walls of the tubular body and the outer walls of the mandrel prior to heating must be considerably less than 0.040 inches. At some stage in the heat-up, the mandrel must be thermally expanded into contact with the tubular body for thermal sizing to be effective. Another problem arises upon assembly when the mandrel is slid into the tubular body. If there is the tight fit necessary for later expansion and if the size and straightness are outside acceptable limits of variation, it will either cause the mandrel to gall or mar the inner walls of the tubular body or prevent the mandrel from being forced in.

Attempts have been made to solve these problems in a number of different ways. One such method is described in U.S. Pat. No. 3,559,278. The tubular body is formed by bending a long flat strip of metal around a mandrel having a circular cross-section. The longitudinal edge surfaces of the metal strip are butt welded together. The tubular body which is thus formed is in close contact with the mandrel. Next, the assembly is heated to a predetermined temperature. The selected temperature is a function of the mandrel size, the desired final dimensions of the tubular body, and the difference between the coefficients of thermal expansion of the mandrel and the tube. Further, the selected temperature must be high enough for the mandrel to create sufficient lateral stress to expand the tube so that, upon cooling, the tube has the required lateral, i.e. cross-sectional, dimensions. This method of welding the tube around the mandrel obviates the need for sliding the mandrel into the tubular body, but adds complexity to the welding steps since welding must be performed while the mandrel is inside the tubular body.

Another method for assembling the mandrel and tubular body is described in U.S. Pat. No. 3,986,654. An approximately sized but somewhat oversized tubular body is mounted on a mandrel having a larger coefficient of thermal expansion than the tubular body. The ends of the mandrel are attached to the ends of the tubular body. On heating, the tubular body is first stressed longitudinally by the lengthening of the mandrel. This action causes the inner walls of the tubular body to contract in a lateral direction so as to contact the outer walls of the mandrel. Subsequently, as the mandrel expands laterally at a greater rate than the tubular body, the latter is expanded in both lateral and longitudinal directions. This method avoids the need for a tight fit between the tubular body and the mandrel and hence it obviates the problem of marring the tubular body during assembly.

Such methods as described above have made possible the fabrication of elongated hollow bodies to closer tolerances than had been previously possible. Nevertheless, certain problems still persist. Forming the tubular body around the mandrel with consistent, continuous, surface-to-surface contact has been found to be difficult with particular metals, e.g. metals used to make nuclear fuel channels. Further, the need to attach the ends of the mandrel and tubular body creates an added degree of complexity in the fabrication process. Also, the longitudinal stretching may adversely affect the wall thickness of the tubular body. Additionally, if the tubular body and mandrel are not in surface-to-surface contact at the beginning of the heating step, then full advantage is not taken of the lateral expansion of the mandrel. As a consequence, the temperature to which the assembly must be heated is higher, thus making the process less efficient.

OBJECTS OF THE INVENTION

It is therefore a principal object of the present invention to provide a new and improved method for making elongate channels and other hollow, thin-walled, elongate shapes which is not subject to the foregoing problems and disadvantages.

It is another object of this invention to provide a new and improved method which is especially suited for the fabrication of elongate nuclear fuel channels of rectangular cross section.

It is a further object of this invention to provide a new and improved method of fabricating nuclear fuel channels which is characterized by a unique degree of dimensional accuracy and stability.

It is still a further object of this invention to provide a method of producing fuel channels free from mechanical defects and residual stresses for use in nuclear reactors.

SUMMARY OF THE INVENTION

In carrying out the method which constitutes the subject matter of the present invention, a hollow channel preform is brought into continuous surface-to-surface contact with a mandrel by drawing an assembly of the loosely fitting-preform and mandrel through a drawing die. In the subsequent thermal sizing operation, a single heating cycle is used to attain high lateral dimensional accuracy of the resulting channel. Such accuracy is determined by the dimensions of the mandrel, by the differential in expansivity between the mandrel and preform, and by the temperature to which the assembly is heated.

These and other objects of the present invention, together with the features thereof, will become apparent from the following detailed description and from the accompanying drawings in which applicable reference numerals have been carried forward.

DETAILED DESCRIPTION OF THE INVENTION

Figure 1:
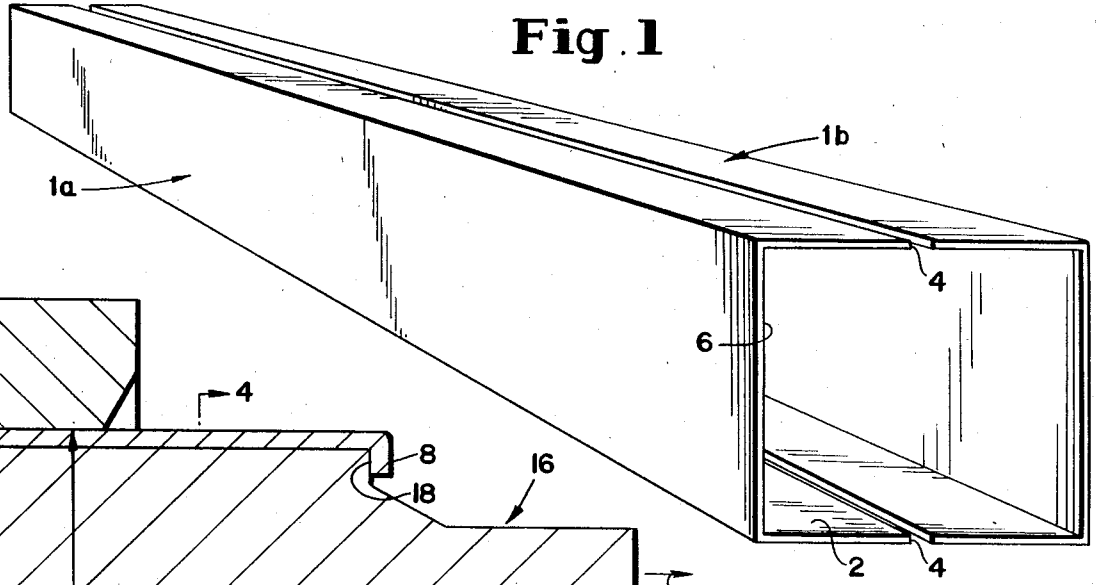
FIG. 1 illustrates two U-shaped channel preform components shown spaced apart for purposes of illustration.

With reference now to the drawings, it should be noted that, in order to effectively illustrate certain features of the inventive method, the apparatus shown in the respective drawing figures is not drawn to scale. FIG. 1 illustrates a pair of channel preform components 1*a* and 1*b*. In a preferred embodiment of the invention, each component may be formed from a long flat strip of the desired preform material, e.g. from a strip of zirconium alloy. Each strip is subsequently bent into the desired shape of a preform component by any of various known techniques, e.g. by the use of a bending brake, to provide such component with a substantially U-shaped cross-sectional configuration. As shown, each preform component has a base wall 6 and two mutually facing side walls 2. Each side wall 2 includes in a longitudinal edge surface 4.

The two preform components so provided are then positioned as shown in FIG. 1 and are moved toward each other until their longitudinal edge surfaces are in abutting contact throughout their length. Next the contacting edge surfaces are welded together, e.g. by tungston inert gas welding, to form a hollow channel preform 14 having a substantially uniform rectangular cross section of twice the cross-sectional area of each component alone. In a preferred embodiment of the invention, the preform is about 5 inches square in cross section and about 13 feet long, with a wall thickness of about 3/32 inches. On occasion, during the welding step weld beads form along the weld seam inside and outside the preform. Upon completion of the welding operation, these beads are reduced to the extent desired by a technique known as planishing.

Figure 2:
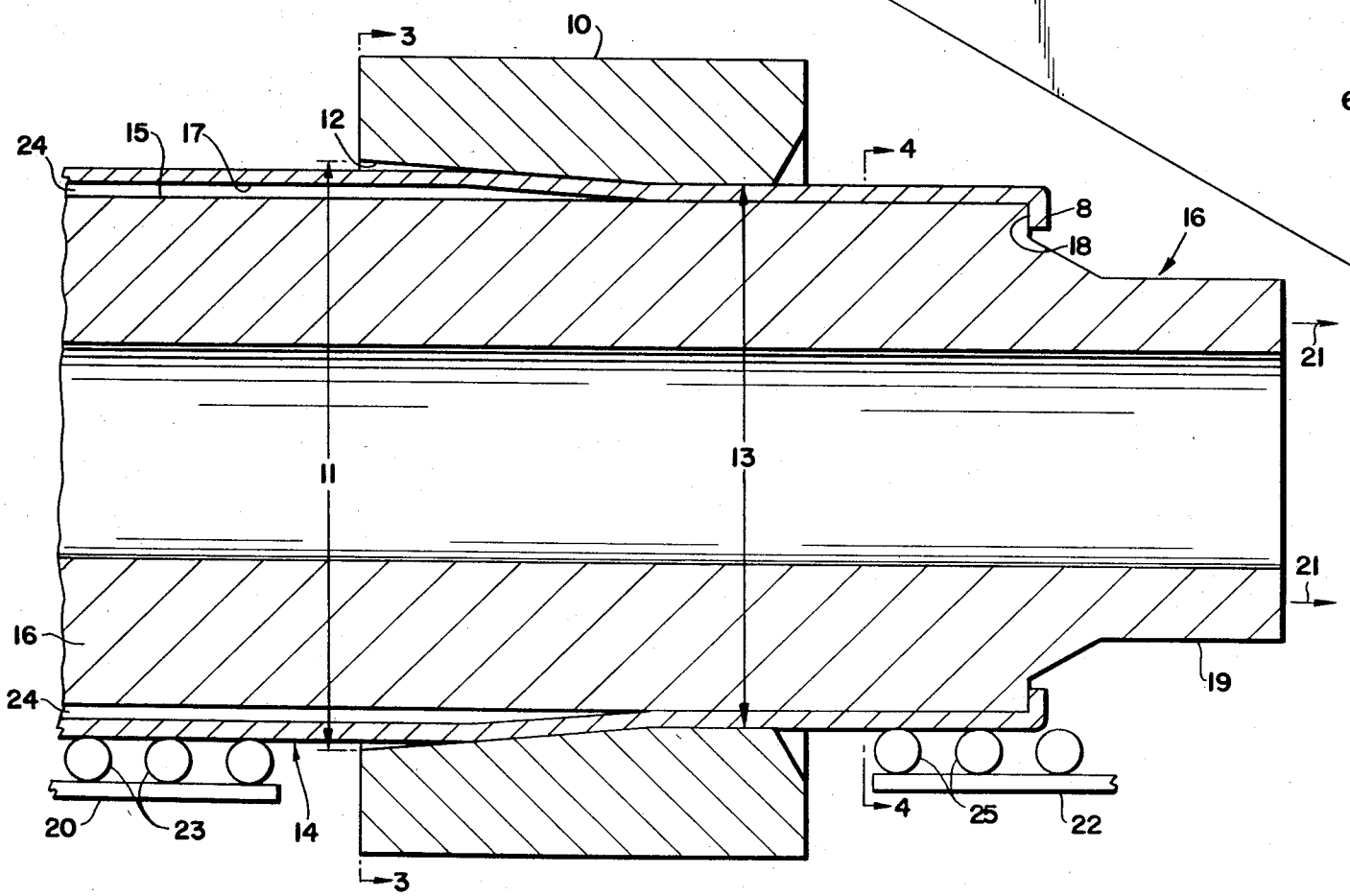
FIG. 2 illustrates a cross-sectional elevation view of a channel in the process of fabrication.
Figure 3:
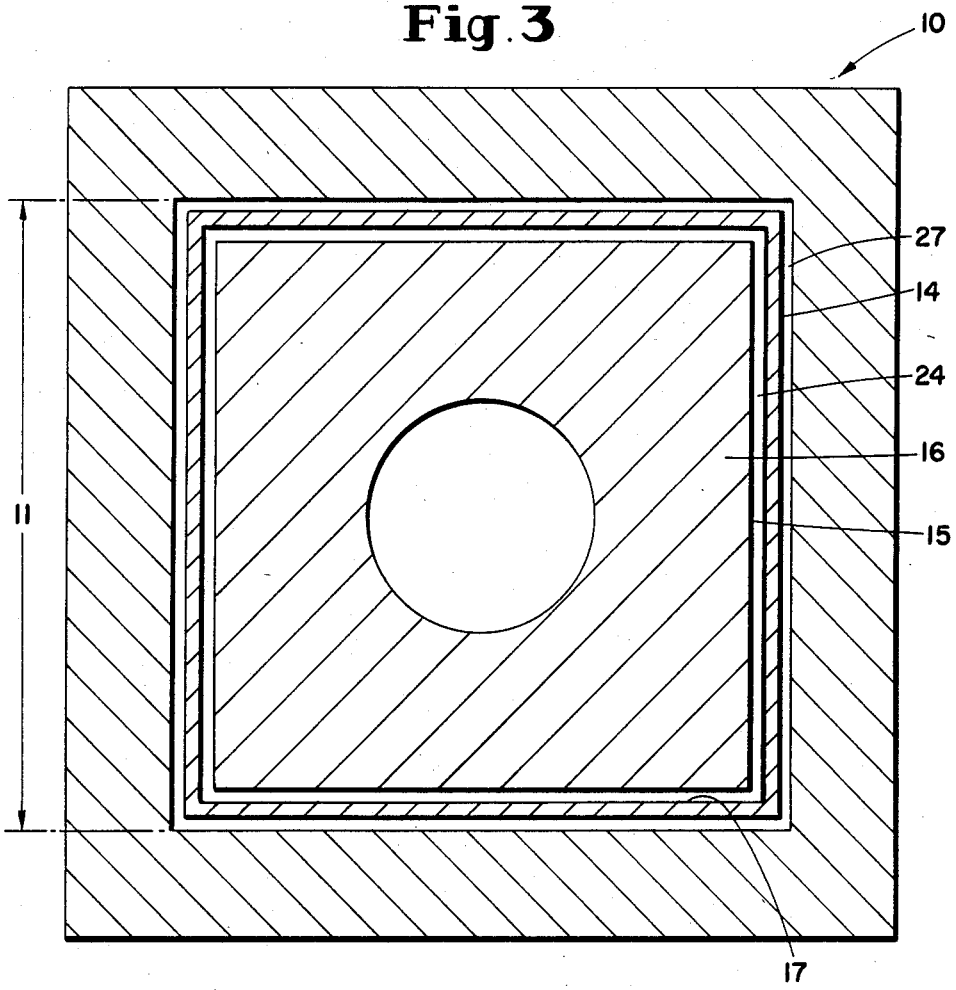
FIG. 3 illustrates a lateral cross-sectional view taken at line 3—3 in FIG. 2.

In the next step of the operation, a mandrel 16 is inserted into the preform. The mandrel, as shown in FIGS. 2 and 3, is hollow in order to reduce its weight, but could be solid as well. At this stage of the operation, the interior lateral dimensions of preform 14 are about 1/16" larger on each side than the corresponding exterior dimensions of mandrel 16, the space between them being indicated by reference numeral 24. Thus, a loose sliding fit is provided between the mandrel and the preform, which prevents galling or marring of the preform inner walls, such as would be caused with a tight fit.

FIG. 2 illustrates in cross section the preform/mandrel assembly, consisting of preform 14 and mandrel 16. The leading end 8 of preform 14 is peened over a portion of the mandrel leading end 18. As shown, leading end 18 tapers down to a narrow mandrel portion 19 to which draw bench grips may be attached in order to pull the preform/mandrel assembly in the direction of arrows 21.

During fabrication, the preform/mandrel assembly is drawn through a drawing die 10, preferably while supported on rollers. As shown, the assembly is supported by rollers 23 in a feed trough 20 as it feeds through a tapered receiving face 12 of die 10, and by rollers 25 in an exit trough 22 as it exits the die. Die 10 has a progressively decreasing, internal, rectangular cross section between its initial lateral cross section indicated at 11 and its terminal lateral cross section indicated at 13. As best shown in FIG. 3, the internal dimensions of initial cross section 11 of die 10 exceed the outer cross-sectional dimensions of preform 14, the space between them being indicated by reference numeral 27, so as to facilitate the insertion of the perform/mandrel assembly into the die.

Figure 4:
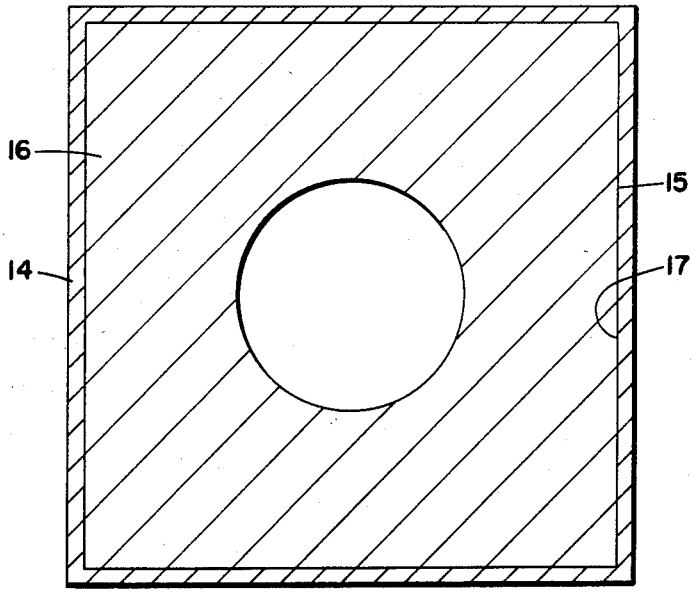
FIG. 4 illustrates a lateral cross-sectional view taken at line 4—4 in FIG. 2.

In operation, as the assembly is drawn through the die, the walls of preform 14 are caused to die sink, i.e. they are collapsed, onto the walls of mandrel 16. This step causes some slight lengthening of the preform on the mandrel. Upon completion of the drawing step, the interior preform wall surfaces 17 and the exterior mandrel wall surfaces 15 are in surface-to-surface contact throughout the full length of the preform, indicated as 15/17 in FIG. 4. This surface contact is established in order to reduce the temperature rise required during the subsequent heating step. By beginning the heating step with such surface contact, the subsequent expansion of mandrel 16 due to heating immediately begins to deform preform 14, without the necessity for mandrel expansion to first close the gap between the mandrel and preform. This allows the selection of a lower and metallurgically more desirable temperature to which the assembly must be heated in order to achieve the desired effect.

In a preferred embodiment of the invention, mandrel 16 consists of a metal selected to have a coefficient of thermal expansion significantly greater, e.g. about 2–3 times that of the preform. During thermal sizing, the preform/mandrel assembly is heated in an inert atmosphere, e.g. in a vacuum, or in a gas such as argon. The preform is forced by the expansion of the mandrel in the longitudinal and lateral directions to expand with the latter. For purposes of the present invention, expansion in the lateral direction alone is significant and it depends on the predetermined temperature to which the assembly is heated. The latter temperature is selected to fall between about 700° F. and 1400° F., with the temperature used in the preferred embodiment being about 800° F. to 1100° F.

For purposes of stress relief annealing while thermal sizing is in progress, the assembly is held at the selected temperature for a period of up to four hours. A period of about 2 hours is generally sufficient for the assembly to reach equilibrium temperature and to relieve internal stresses built up in the preform material during the cold-working steps.

In each instance, the upper temperature to which the assembly is heated will be determined by the coefficients of thermal expansion of the preform and the mandrel, by the dimensions of the mandrel at room temperature and by the desired room temperature dimensions of the finished product, i.e. the sized channel. The relationship between the sizes and coefficients of thermal expansion of the preform and mandrel and the temperature to which the assembly is heated is expressed by the following equation:

$$Wm = Wc(1+KcT)/(1+KmT)$$

where

Wm = width of the mandrel

Wc = width of the sized channel

Kc = coefficient of thermal expansion of the channel material

Km = coefficient of thermal expansion of the mandrel material

T = temperature difference between the temperature to which the assembly is heated and room temperature.

In a preferred embodiment of the invention the preform consists of a zirconium alloy material, such as commercially available Zircaloy, and the mandrel material is A.I.S.I. Type 304 stainless steel. These two metals provide the desirable degree of mismatch of the coefficients of thermal expansion.

In the next step of the operation, the assembly is cooled to room temperature, thus causing the preform to contract to the desired final size of the channel. Because of its larger coefficient of thermal expansion, the mandrel will contract to a greater extent than the preform. Hence, at room temperature the channel is clear of the mandrel and the mandrel can then be easily slipped out of the uniformly straight and sized channel in a direction away from the peened-over channel end. Upon removal of the mandrel, the channel is trimmed to the required length by cutting off the aforesaid peened-over end and is then ready for use following the required metal finishing steps.

The invention described and illustrated herein facilitates the manufacture of channels of 10 feet or more in length and it is most advantageously employed in the fabrication of channels to very close tolerances. The final product can be held to extremely small dimensional variations in cross section and further minimizes bowing and twisting of the channel. These features make the method described herein well suited for use in the fabrication of nuclear fuel channels of the kind which duct coolant around the fuel rods in a boiling water reactor, and which must be made from such difficult-to-fabricate metals as zirconium alloy.

While the present invention has been described in connection with the fabrication of fuel channels from zirconium alloy, it is equally applicable to the fabrication of such channels from other hard-to-shape metals, such as titanium, or hafnium, and alloys thereof. Further, the method which constitutes the subject matter of the present invention may be advantageously used in the fabrication of tubular bodies of any desired cross section, including circular or polygonal cross section. It will also be understood that the invention is not limited to any particular metal shaping techniques prior to sizing and that the technique selected will depend largely on the desired shape and on the available equipment.

The mandrel used in the inventive method described herein can be made of any suitable material having a coefficient of thermal expansion larger than, and preferably at least twice, that of the channel material. However, it is essential that the mandrel be hard enough at the heating and annealing temperatures, compared to the preform, to create sufficient lateral stresses to hot work and permanently deform the preform material. The cross-sectional shape and dimensions of the mandrel are chosen to produce tubular bodies of the desired final shape and dimensions. For example, if it were desired to produce a cylindrical tubular body, a mandrel with a circular cross section could be selected. However, the mandrel chosen need not fully conform to the desired shape of the tubular body. For example, each exterior surface of the mandrel shown in cross section in FIG. 3 could have a central trough which runs the full length of the mandrel. Mandrels are occasionally made in that form for purposes related to mandrel strength and/or mandrel handling. It will be clear to those skilled in the art that a mandrel with the cross-sectional configuration described is capable of expanding the lateral dimensions of preform 14 in similar manner as mandrel 16.

While the present invention has been shown and described with reference to a preferred embodiment, it will be understood that numerous modifications, changes, variations, substitutions and equivalents will now occur to those skilled in the art without departing from the spirit and scope of the invention. Accordingly, it is intended that the invention herein be limited only by the scope of the appended claims.

What is claimed is:

1. A method for making a precisely sized hollow channel from an elongate metal channel preform, said method comprising the steps of:

(a) inserting an elongate metal mandrel into said preform, said mandrel having a cross-sectional configuration conforming at least in part to said preform substantially along the full length of the latter and being dimensioned to provide a loose sliding fit upon assembly with said preform, the coefficient of thermal expansion of said mandrel being greater than that of said preform;

(b) drawing the assembly of said preform and mandrel through a die, said die including a cross section effective to die sink the walls of said preform into surface-to-surface contact with said mandrel during said drawing step substantially throughout the length of said preform;

(c) heating said drawn assembly to a predetermined temperature to expand said mandrel and said preform by amounts dictated by their respective coefficients of expansion, said heating step being effective to deform the cross section of said preform to conform to the lateral expansion of said mandrel;

(d) cooling said assembly to room temperature, said cooling step being effective to reduce said preform to a channel having precisely determined cross-sectional dimensions at said room temperature and being clear of said mandrel;

(e) removing said mandrel from said channel; and (f) trimming said channel to the desired length.

2. The method as set forth in claim 1 wherein said channel preform is fabricated by the steps of:

a. forming a pair of elongate channel preform components from flat strip metallic stock, each of said preform components having a substantially U-shaped cross-sectional configuration including a base wall intermediate a pair of mutually facing side walls, said side walls terminating in a pair of parallel, longitudinal edge surfaces;

b. positioning said channel components with said longitudinal edge surfaces in mutual contact throughout their length; and c. welding said contacting edge surfaces together throughout their length, said welding step being effective to provide a preform having a substantially uniform rectangular cross section.

3. The method as set forth in claim 2 wherein said welding step produces a pair of weld beads along the weld seams of said pair of contacting edge surfaces; and said method further including the step of reducing said weld beads by planishing said preform internally and externally.

4. The method as set forth in claim 1, wherein the constituent metal of said preform is a zirconium alloy and the constituent metal of said mandrel is stainless steel.

5. The method as set forth in claim 2, wherein said heating step is effective to reduce previously built up stresses in said channel by annealing.

6. The method as set forth in claim 1, wherein said preform and said mandrel each have a polygonal cross-sectional configuration.

7. The method as set forth in claim 6 wherein said cross-sectional configuration is a rectangle.

8. The method as set forth in claim 7 wherein said cross-sectional configuration is a square.

9. A method for making a zirconium alloy fuel channel with precisely determined dimensions, said method comprising the steps of:

a. forming a pair of elongate channel preform components from flat strip zirconium alloy stock, each of said components having a substantially U-shaped cross-sectional configuration including a base wall intermediate a pair of mutually facing side walls, said side walls terminating in a pair of parallel longitudinal edge surfaces;

b. positioning said channel components with said longitudinal edge surfaces in mutual contact throughout their length;

c. welding said contacting edge surfaces together througout their length, said welding step being effective to provide a preform having a substantially uniform rectangular cross section and producing weld beads along the seams of said contacting edge surfaces;

d. reducing said weld beads by planishing said preform internally and externally;

e. inserting an elongate stainless steel mandrel into said preform having a coefficient of thermal expansion greater than that of zirconium alloy, said mandrel having a cross-sectional configuration conforming at least in part to said preform along the full length of the latter and being dimensioned to provide a loose sliding fit upon assembly with said preform;

f. drawing the assembly of said preform and said mandrel through a die of rectangular cross section having internal cross-sectional dimensions which proportionally correspond to the cross section of said preform, said drawing step being effective to die sink the walls of said preform into surface-to-surface contact with said mandrel substantially throughout the length of said preform;

g. heating said assembly to a predetermined temperature of approximately 1100° C. for a period of about two hours, said heating step being effective to deform the cross section of said preform to conform to the lateral expansion of said mandrel, said heating step being further effective to anneal out stresses previously built up in said preform;

h. cooling said assembly to room temperature, said cooling step being effective to reduce said preform to a channel having precisely determined cross-sectional dimensions at said room temperature and being clear of said mandrel;

i. removing said mandrel from said channel and;

j. trimming said channel to the desired length.

* * * * *